US010932646B2

(12) United States Patent
Weaver et al.

(10) Patent No.: US 10,932,646 B2
(45) Date of Patent: Mar. 2, 2021

(54) SELECTIVELY ADJUSTABLE CLEANING DEVICE

(71) Applicant: Quickie Manufacturing Corporation, Cinnaminson, NJ (US)

(72) Inventors: Jace Weaver, Gilbertsville, PA (US); David Wilusz, Abington, PA (US)

(73) Assignee: Rubbermaid Commercial Products LLC, Huntersville, NC (US)

( * ) Notice: Subject to any disclaimer, the term of this patent is extended or adjusted under 35 U.S.C. 154(b) by 776 days.

(21) Appl. No.: 15/370,401

(22) Filed: Dec. 6, 2016

(65) Prior Publication Data

US 2018/0015607 A1 Jan. 18, 2018

Related U.S. Application Data

(60) Provisional application No. 62/361,476, filed on Jul. 12, 2016.

(51) Int. Cl.

| | |
|---|---|
| ***A47L 13/38*** | (2006.01) |
| ***A46B 5/00*** | (2006.01) |
| ***B25G 3/38*** | (2006.01) |
| ***A47L 13/20*** | (2006.01) |
| ***B25G 3/36*** | (2006.01) |
| ***B25G 3/02*** | (2006.01) |

(52) U.S. Cl.

CPC ..... *A47L 13/38* (2013.01); *A46B 5/0087* (2013.01); *A47L 13/20* (2013.01); *B25G 3/02* (2013.01); *B25G 3/36* (2013.01); *B25G 3/38* (2013.01)

(58) Field of Classification Search

CPC ..... A46B 5/0087; A47L 13/38; B25G 3/02; B25G 3/38

See application file for complete search history.

(56) References Cited

U.S. PATENT DOCUMENTS

| | | | | | |
|---|---|---|---|---|---|
| 366,790 | A | * | 7/1887 | Orther | F16C 11/0633 15/144.2 |
| 4,475,262 | A | * | 10/1984 | Downer | A46B 7/06 15/144.2 |
| 4,654,922 | A | * | 4/1987 | Chen | A46B 5/0087 15/144.2 |
| 4,796,325 | A | * | 1/1989 | Bortman | A46B 5/0012 15/144.2 |
| 5,410,771 | A | | 5/1995 | Bereza | |

(Continued)

FOREIGN PATENT DOCUMENTS

| | | | |
|---|---|---|---|
| CN | 2245425 | Y | 1/1997 |
| GB | 218489 | * | 7/1924 |

*Primary Examiner* — Randall E Chin

(74) *Attorney, Agent, or Firm* — Husch Blackwell LLP

(57) ABSTRACT

A multi-purpose cleaning device is provided that can be used with multiple different types of cleaning attachments. The cleaning device includes a handle that is attachable to a socket device that includes several claw members. The claw members have interior portions that are contoured so that the space between the claw members forms a sphere-shaped socket. The cleaning attachments preferably include a ball portion that can be securely mated within the sphere-shaped socket. When the user prefers three degrees of freedom for the attachment, the ball has impeded rotation within the socket. When the user prefers one degree of freedom for the attachment, the ball also includes a rod or post that can releasably lock the ball to the socket.

2 Claims, 7 Drawing Sheets

(56) References Cited

U.S. PATENT DOCUMENTS

| | | | | |
|---|---|---|---|---|
| 5,551,115 | A | 9/1996 | Newville | |
| 6,341,401 | B1 * | 1/2002 | Lin | A47L 13/144 15/119.2 |
| 6,872,021 | B1 * | 3/2005 | Wilson | A47L 13/22 15/104.93 |
| 7,640,617 | B2 * | 1/2010 | Kennedy | A47L 13/20 15/144.1 |
| 2004/0064909 | A1 * | 4/2004 | Locklear | A46B 5/0058 15/160 |
| 2015/0208893 | A1 | 7/2015 | Stephens et al. | |
| 2016/0198923 | A1 | 7/2016 | Stephens et al. | |

* cited by examiner

FIG. 10
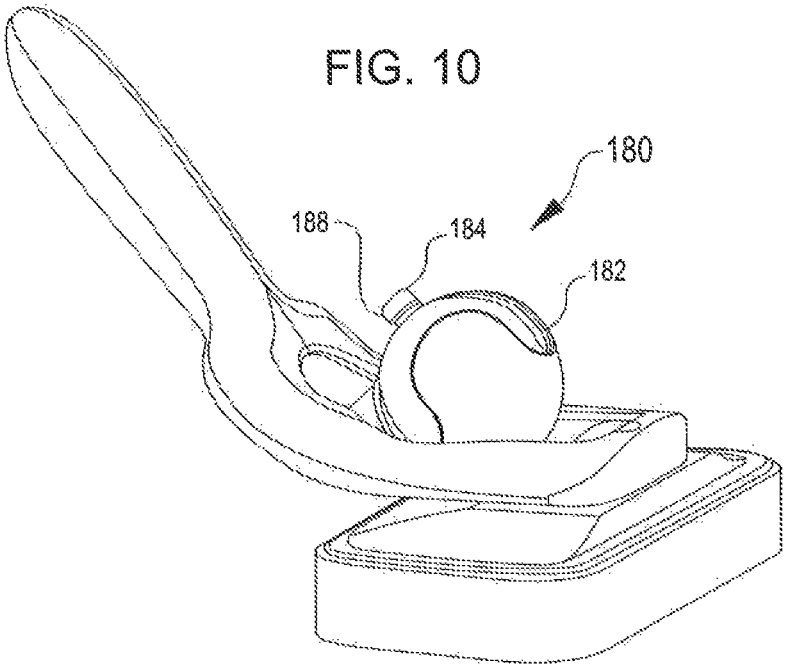
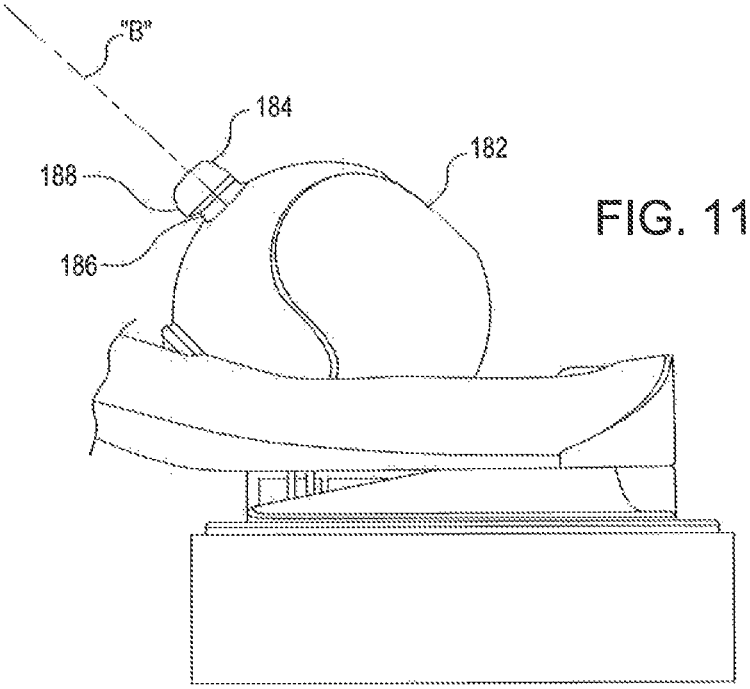
FIG. 11

SELECTIVELY ADJUSTABLE CLEANING DEVICE

CROSS-REFERENCE TO RELATED APPLICATION

The present invention claims priority to U.S. Provisional Application No. 62/361,476 entitled SELECTIVELY ADJUSTABLE CLEANING DEVICE, filed on Jul. 12, 2016, the contents of which are herein incorporated by reference in its entirety.

BACKGROUND OF THE INVENTION

Individuals use a variety of cleaning tools to adequately clean the various locations and surfaces within their homes, apartments, and places of work. An individual may need to use a mop for one surface, a broom for another, a duster for another, etc. It can become difficult and burdensome to store so many tools, especially in smaller dwellings like an apartment or dormitory room. Therefore, people seek house-cleaning tools that serve multiple purposes. Cleaning tool manufacturers have long sought to create cleaning tools to meet demand for multi-purpose tools.

Solutions to the aforementioned problem are available. Handles are commercially available that come with a variety of attachments including broom attachments, mop attachments, duster attachments and the like. Typically, the handle includes a threaded portion to which the various attachments can be attached. The downside to such multi-purpose cleaning tool is that the attachment tool is limited in terms of rotational degrees of freedom at the attachment point. This is helpful for cleaning a floor surface, such as a tile or hardwood floor, because typically no rotational degrees of freedom are needed. The mop or other attachment can retain its stiffness when it is swept forward and backward during use, even during vigorous scrubbing.

However, to adequately clean a dwelling or workplace, surfaces other than hard floor surfaces must also be cleaned. Typically, the distant and hard to reach places (such as light fixtures, the tops of bookshelves, and behind furniture) are the most difficult to clean. Tools with a cleaning tool attached to a handle must often be used for these distant locations. Moreover, it is helpful if the tool can flex and rotate to sufficiently clean the surface. For example, a duster on a handle should be able to flex and rotate so that it can fit into a light fixture recess, a bookshelf top, or a ground surface behind a couch. However, if a traditional multi-purpose handle and duster attachment tool is used, the duster would not have the necessary degrees of freedom to access the hard to reach locations. This makes it especially difficult to clean surfaces such as the top of ceiling fan blades, where it is difficult to position the duster so that it can contact and subsequently sweep the top of the fan blade.

SUMMARY OF THE PRESENT INVENTION

The present invention relates to a cleaning device that is engageable with various cleaning attachments. The cleaning attachments engaged with the device may be rigidly or selectively rotatably held in place, depending on the surface or location being cleaned. The cleaning device preferably includes a handle member, a socket attachment device, and a cleaning attachment member such as a duster, a mop, or the like. The handle member may be preferably selectively engageable with the socket attachment device via a threaded connection, and the socket attachment device is preferably selectively engageable with the various cleaning attachments as set forth below.

When the handle member, socket attachment device, and a cleaning attachment member are assembled, the cleaning device may be used to clean a variety of surfaces. Because of the ball and socket mechanism described below, the cleaning attachment member may be allowed between zero and three degrees of freedom, as discussed below. This allows the attachment member to be rotatable when the attachment member is being used to reach hard to reach locations such as a duster cleaning the top of a bookshelf. When a different cleaning attachment is used for cleaning hard surfaces or the like, the attachment system is modified to allow for one (e.g., roll) or no rotational degree of freedom so that the cleaning attachment can remain stiff during cleaning.

At its upper portion, the socket attachment device may include a threaded cavity that acts as a female mating member able to receive and selectively engage a male mating member of the handle device. The socket attachment device preferably includes several flexible and resilient claw members that extend downwardly from its lower portion. The flexible claw members are preferably contoured or curved inwardly. The empty space between the claw members forms a throat, or socket within the socket attachment device. Because of the inward curve of the flexible claw members, the socket is preferably substantially ball or sphere-shaped. Thus, the socket is preferably sized and shaped for receiving and releasably securing a ball member associated with an attachment member, as described below.

The socket attachment device also may include reinforcement fins that reinforce the claw members when they are outwardly flexed to receive a cleaning attachment member. The reinforcement fins may help prevent the claw members from flexing outwardly so much as to break or otherwise be overly stressed.

An upper interior surface of the socket also preferably includes an aperture positioned and located substantially in the center thereof. The aperture may be predominately circular in shape, so that it can receive and engage a similarly shaped rod or post associated with cleaning attachment members so that only one rotational degree of freedom (e.g., roll) is provided. Other aperture and rod shapes are also envisioned which are not circular in cross-sectional shape, and which would allow for zero degrees of rotational freedom. The preferred embodiment of the socket attachment device is constructed of a plastic and is integrally formed.

A first example cleaning attachment member is a duster attachment member. The duster attachment member preferably includes three primary components. A spherical or globe-shaped ball may be attached to a body member. The body member may be releasably attachable to a duster mitt.

The ball member is preferably sized and shaped so that it can be received and engaged within the flexible claw members and the socket formed between the claw members. When the duster attachment member is ready for use, a user may forcibly push the ball member of the attachment into the socket. When the ball member is pushed into the socket, the flexible claw members flex outwardly to receive the ball member.

The ball member is preferably oversized for the socket. In an example embodiment, the ball member has a diameter which is larger than the diameter of the socket when at rest. Thus, the flexible claw members are flexed outwardly when the ball member is retained within the socket. Pressure applied by the claw members on the ball member allows impeded rotation from friction of the ball member within the socket when the duster attachment member is in use with the cleaning device. This allows a user to move the ball member within the socket to allow for three rotational degrees of freedom. All three degrees of freedom are useful when the duster attachment member should be rotated to allow for cleaning hard-to-reach places. Movement of the ball member is preferably sufficiently impeded within the socket so that the ball member stays substantially in a rigid position during use unless the user elects to rotate the ball member and thus the attachment.

A second cleaning attachment member may also be attachable with the socket attachment device. That cleaning attachment member should be allowed zero or one rotational degree of freedom. As an example cleaning attachment member a mop attachment member may be provided. Like the duster attachment member, the mop member includes a ball member. However, the ball member associated with the mop member preferably also includes a cylinder-shaped rod or post that extends upwardly away from the ball member. The post is preferably sized and shaped to fit into the aperture in the throat of the socket. Thus, when installed within the socket, the ball member is unable to pitch or yaw within the socket. This allows the ball member to remain securely in place and allows the mop member to have one rotational degree of freedom (e.g., roll about the longitudinal axis of the post). Thus, the mop may remain rigid when used to vigorously scrub a floor or other principally flat surface.

The cleaning device may be used with a variety of cleaning attachments other than a duster attachment member or a mop attachment member. The other cleaning attachments all preferably include a ball member that is selectively engageable with the socket of the socket attachment device. Depending on the intended use for the attachment, the ball member may or may not include a rod or post to limit the attachment's degrees of freedom.

BRIEF DESCRIPTION OF THE DRAWINGS

In the accompanying drawings, which form a part of the specification and are to be read in conjunction therewith in which like reference numerals are used to indicate like or similar parts in the various views:

FIG. 10 is a perspective view of an alternative mop attachment member;

FIG. 11 is a partial side elevation view of the alternative mop attachment member of FIG. 10.

DETAILED DESCRIPTION OF THE INVENTION

A selectively adjustable cleaning device 1 is provided that is engageable with various cleaning attachments. The cleaning attachments may be rigid or rotatably engaged, depending on the surface or location being cleaned. The cleaning device 1 includes a handle member 3, a socket attachment device 5, and a duster attachment member 7. The handle member 3 is preferably a narrow handle that is substantially similar to those used for mops, brooms, and other cleaning devices. The handle member 3 is preferably easily grippable and ergonomically comfortable. The handle member 3 is selectively engageable with the socket attachment device 5 in the manner described below, and the socket attachment device 5 is selectively engageable with the duster attachment member 7 in the manner described below.

When the handle member 3, socket attachment device 5, and duster attachment member 7 are assembled, cleaning device 1 may be used to dust various hard to reach locations in a dwelling or workplace. Because of the ball and socket mechanism described below that attaches the duster attachment member 7 to the socket attachment device 5, the duster attachment member 7 includes three degrees of rotational freedom: yaw, pitch, and roll. With three rotational degrees of freedom, the duster attachment member 7 is able to reach the locations that are often most difficult to clean. However, as will be described in greater detail herein below, duster attachment member 7 may be substituted for another cleaning attachment that can perform cleaning functions other than dusting. When the substitute cleaning attachment is used for cleaning hard surfaces, the attachment system is modified to allow for one or no rotational degrees of freedom so that the cleaning attachment can remain stiff during cleaning.

Figure 1:
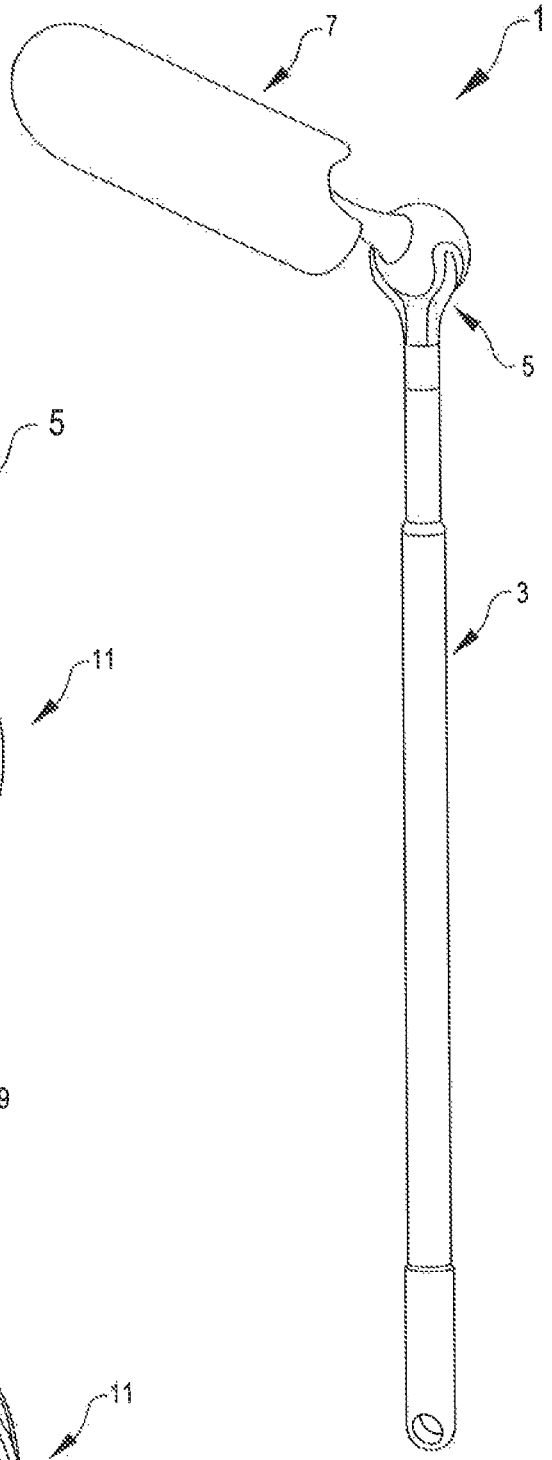
FIG. 1 is a perspective view of a selectively adjustable cleaning device according to the teachings of the present invention.
Figure 2:
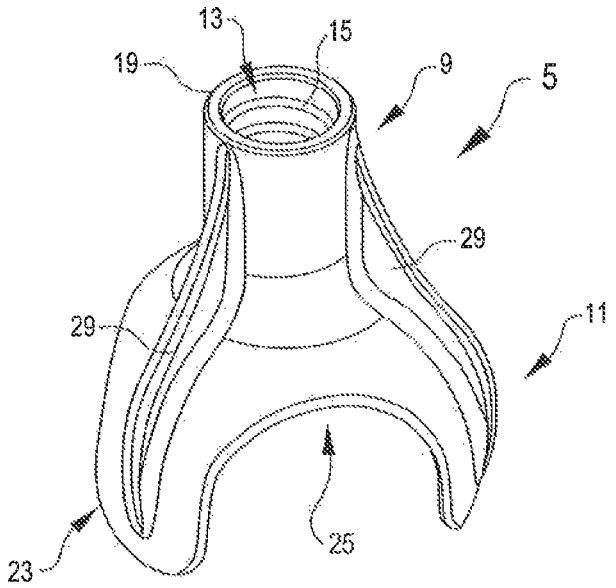
FIG. 2 is a perspective view of a socket attachment device of the selectively adjustable cleaning device of FIG. 1.
Figure 3:
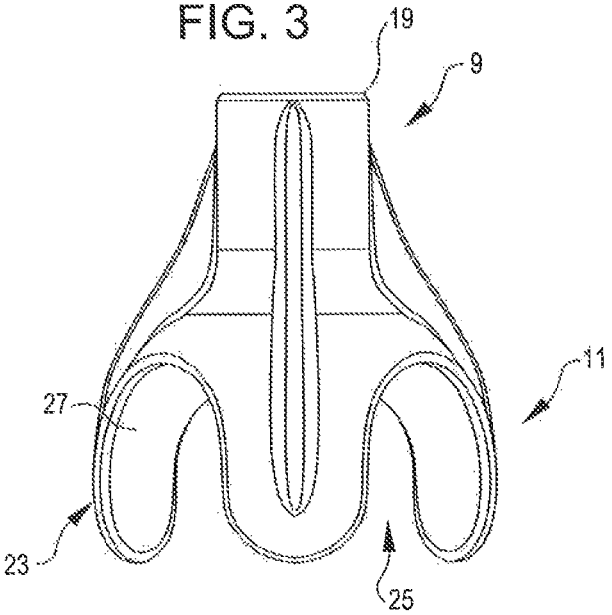
FIG. 3 is an elevation view of the socket attachment device of FIG. 2.

Turning now to FIGS. 2 and 3, the socket attachment device 5 includes each of an upper portion 9 and a lower portion 11. At its upper portion 9, the socket attachment device 5 preferably includes a threaded cavity 13 that extends downwardly into the upper portion 9 of the socket attachment device 5. The threaded cavity 13 acts as a female mating member having threads 15 that are able to receive and engage a male mating member (not illustrated) of handle member 3. The threaded extension member also includes threads. When the threaded extension member of the handle member 3 is inserted into the threaded cavity 13, the threads 15 and the threads from the threaded extension member may be operable to engage the handle member 3 with the socket attachment device 5.

In alternative embodiments, the handle member 3 and the socket attachment device 5 may be secured to one another by, for example, friction fit, a clipping mechanism, or any other foreseeable attachment method. The socket attachment device 5 preferably includes an outer lip 19 that extends around the circumference of its upper portion 9. The handle member 3 also includes a ledge (not illustrated) just above the threaded extension member 17 of the handle member 3 that extends around the circumference of the handle member 3. When the handle member 3 and the socket attachment device 5 are attached to one another, the outer lip 19 preferably abuts the ledge, thus further securing the handle member 3 to the socket attachment device 5.

The socket attachment device 5 preferably includes several flexible claw members 23 that extend downwardly from the lower portion 11 of the socket attachment device 5. The flexible claw members 23 are preferably evenly spaced from one another. In the illustrated embodiment, the claw members 23 are each contoured or curved inwardly. The empty space between the claw members 23 forms a throat, or socket 25 within the socket attachment device 5. Because of the inward curve of an interior surface 27 (as shown in FIG. 3) of the flexible claw members 23, the socket 25 is preferably substantially ball or sphere-shaped. Therefore, the socket 25 is of a size and shape suitable for receiving and securing a ball member associated with an attachment member such as the duster attachment member 7, as described below.

The socket attachment device 5 also may include reinforcement fins 29 that connect the upper portion 9 and the lower portion 11 to one another. The reinforcement fins 29 are attached to the socket attachment device 5 at its upper portion 9 near the lip 19, and the reinforcement fins 29 are attached to the lower portion 11 of the socket attachment device 5 at each of its flexible claw members 23. The reinforcement fins 29 are preferably attached at the upper portion 9 and lower portion 11 along the length of each of the flexible claw members 23. Therefore, when the flexible claw members 23 are outwardly flexed to receive an attachment member such as duster attachment member 7, the flexible claw members 23 are reinforced by the reinforcement fins 29. The reinforcement fins help prevent the claw members 23 from flexing outwardly so much as to break or otherwise be overly stressed.

As shown and described, the socket attachment device 5 includes three flexible claw members 23. However, in alternative embodiments, more claw members 23 may be provided. In embodiments where more claw members 23 are provided, the claw members 23 should still be curved or contoured so as to form a generally spherical socket 25 for receiving a ball member of a cleaning attachment member, such as attachment member 7. Also, in cases where more claw members 23 are provided, the claw members 23 should still be sufficiently flexible so as to allow the claw members to flex outwardly to receive a cleaning attachment member. If more flexible claw members 23 are present, it is foreseeable and likely that more reinforcement fins 29 would also be provided to support the additional claw members when they are flexed outwardly.

Figure 4:
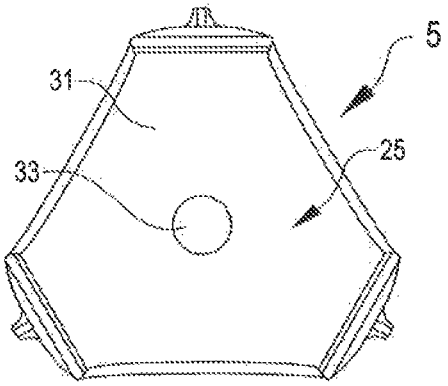
FIG. 4 is a bottom plan view of the socket attachment device of FIGS. 2 and 3.

Turning to FIG. 4, an upper interior surface 31 of the socket attachment device 5 includes an aperture 33 positioned and located substantially in the middle of interior surface 31. The aperture 33 is illustrated in FIG. 4 as being predominately circular in shape, so that it can receive and engage a similarly shaped rod or post associated with cleaning attachment members for which only one degree of freedom is necessary (as described herein below when describing FIGS. 7-9). The preferred embodiment of the socket attachment device 5 is constructed of a plastic. It is possible that the socket attachment device 5 is constructed of another material so long as that other material is able to flex in the manner described above.

In the embodiment shown and illustrated, the socket attachment device 5 is integrally formed so as to be constructed from the same material with no need for assembly. In alternative embodiments, the upper portion 9 and the lower portion 11 of the socket attachment device 5 may be modular such that assembly is required. Also, in yet another alternative embodiment, the socket attachment device 5 may be integrally formed with the handle member 3 such that the threaded attachment mechanism described hereinabove is not necessary.

Figure 5:
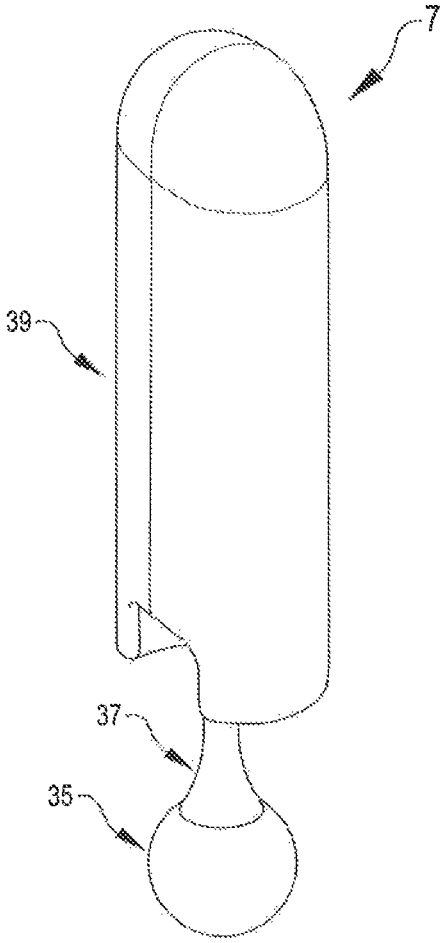
FIG. 5 is a perspective view of a duster attachment member that is selectively engageable with the socket attachment device of FIGS. 2-4.
Figure 6:
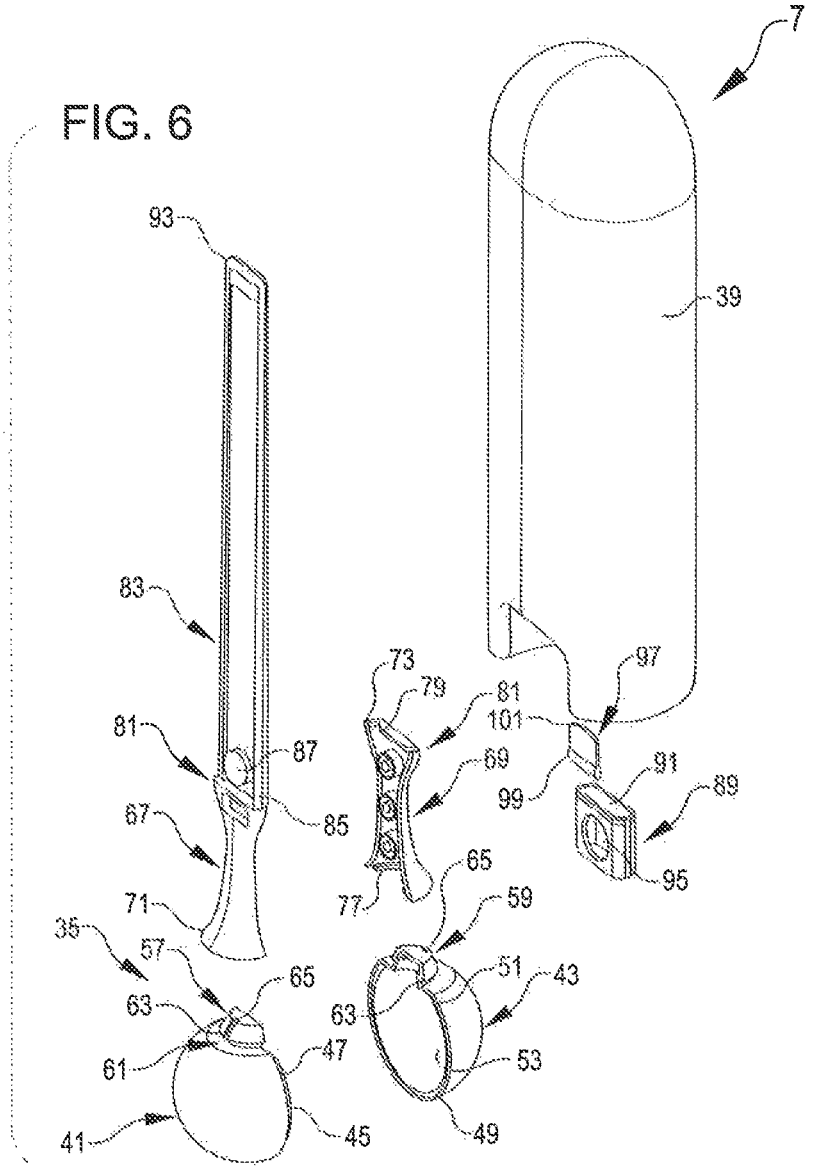
FIG. 6 is an exploded view of the duster attachment member of FIG. 5.

The duster attachment member 7 is shown as assembled in FIG. 5, and exploded in FIG. 6. The duster attachment member 7 preferably includes three primary components. A ball member 35, which is substantially spherical or globe-like in shape, is attached to a body member 37. The body member 37 receives and secures a duster mitt 39.

The ball member 35 may be sized and shaped so that it may be received and engaged within flexible claw members 23 and the socket 25 within the claw members 23. When attachment member 7 is ready for use, a user may apply pressure to force ball member 35 into the socket 25. When doing so, the flexible claw members 23 flex outwardly to receive the ball member 35.

When the ball member 35 is engaged within the socket 25, the surface of the ball member 35 abuts the interior surface of 27 of the claw members 23 and the interior surface 31 of the socket attachment device 5. The ball member 35 is preferably oversized for the socket 25 such that the flexible claw members 23 are somewhat flexed outwardly when the ball member 35 is retained within the socket 25. Pressure applied by the claw members 23 on the ball member 35 allows impeded rotation of the ball member 35 within the socket 25 when the duster attachment member 7 is being used with the socket attachment device 5 and handle member 3. This allows a user to move the ball member 35 within the socket 25 with three rotational degrees of freedom. All three rotational degrees of freedom are useful when the duster mitt 39 is rotated to allow for cleaning hard-to-reach places. Rotation of the ball member 35 is sufficiently impeded by the grip of the claw members 23 within the socket 25 so that the ball member 35 stays substantially in one position unless the user elects to manually rotate the ball member 35.

The ball member 35 may be made up of two selectively engageable halves: male hemisphere 41 and female hemisphere 43. Male hemisphere 41 preferably includes a raised flange 45 that substantially circumscribes its interior wall 47. The female hemisphere 43 includes a recessed rim 49 that substantially circumscribes its interior wall 51. Each of the male hemisphere 41 and the female hemisphere 43 preferably include substantially hollow interior portions 53 (only illustrated in FIG. 6 for female hemisphere 43).

When the hemispheres 41, 43 are placed in substantial alignment with one another, the raised flange 45 and the recessed rim 49 also are in substantial alignment with one another. Because the flange 45 is raised and the rim 49 is recessed, the raised flange 45 may act as a male mating member that can be received and secured within the recessed rim 49, thus selectively engaging the hemispheres 41, 43 to one another so as to form the ball member 35. Neck portions 57, 59 of hemispheres 41, 43, may not include flanges 45 or rim 49, respectively. Neck portions 57, 59 are preferably bounded at lower ends 61 by a channel 63 formed in each of the hemispheres that extends around the circumference of the hemispheres 41, 43. When the hemispheres 41, 43 are placed so that they abut one another, the channels 63 of each of the neck portions 57, 59 are similarly in substantial alignment to one another. Together the channels 63 completely extend around the circumference of the ball member 35. Other constructions for the ball member 35 are envisioned.

When the hemispheres 41, 43 are placed in an abutting position and the recessed rim 49 has received and secured the raised flange 45, the hemispheres 41, 43 are preferably sonic welded to each other. When the hemispheres 41, 43 are welded or otherwise attached to one another to one another, the ball member 35 illustrated in FIG. 5 is formed. Each of the neck portions 57, 59 of the hemispheres 41, 43 further may include vertical slots 65 that extend upwardly from the channel 63 to the top of the neck portions 57, 59. Vertical slots 65 may be used to help secure the body member 37 to the ball member 35.

The body member 37 of the duster attachment member 7 preferably includes each of a front body portion 67 and a rear body portion 69. Each of the front body portion 67 and the rear body portion 69 preferably include a base portion 71 that is wider than the other portions of the body member 37. Interior 73 of the front body portion 67 and the rear body portion 69 includes a lip 77 formed from the base portion 71 that extends inwardly from the base portion 71. To attach the body member 37 to the ball member 35, the lip 77 of the front body portion 67 is placed such that the channel 63 of the male hemisphere 41 receives the lip 77 therewithin. Similarly, the lip 77 from the rear body portion 69 is preferably positioned such that the channel 63 from the female hemisphere 43 receives and engages the lip 77. The lip 77 is preferably a width that is just smaller than the width of the channel 63 such that the lips 77 are securely retained within the channels 63 when the lips 77 are pushed into the channels 63. Preferably, the body portions 67, 69 also include vertical flanges (not illustrated) that are received and engaged by vertical slots 65 of the neck portions 57, 59 to further allow the body member 37 and ball member 35 to be securely engaged within one another.

Rear body portion 69 further may include an attachment slot 79 at its upper end 81 at an interior 73 thereof. Attachment slot 79 is preferably a horizontal female receiver member that extends across the width of the interior 73 of the upper end 81. The attachment slot 79 is preferably sized and shaped to act as a female mating member with a male extension member (not illustrated) located on the interior 73 of the front body portion 67 for selective mating with the attachment slot 79. Other mechanisms for securing the front body portion 67 to the rear body portion 69 are also contemplated herein. It is also foreseeable that the front body portion 67 and the rear body portion 69 may be sonic welded to one another in a manner substantially similar to the hemispheres 41, 43.

The front body portion 67 also may include an extension member 83 extending upwardly from its upper end 81. In the preferred embodiment, the extension member 83 is preferably integrally formed with the front body portion 67, but alternatively, it may be selectively attachable to the front body portion 67 in a known or foreseeable manner. The extension member 83 is preferably of approximately the same width as the front body portion 67, but the extension member 83 is substantially longer than either of the body portions 67, 69. In alternative embodiments, the extension member 83 may be associated with the rear body portion 69 instead of the front body portion 67. In that embodiment, the extension member 83 would serve substantially the same purpose and be operated in substantially the same manner as described below.

At a lower end 85 of the extension member 83, a circular knob 87 may be formed from the extension member 83 that projects outwardly from the extension member 83. The knob member 87 is preferably circular in shape, though in alternative embodiment it may take on a different shape. No matter the shape that the knob member 87 takes on, it should be sized and shaped to be selectively engageable with a mitt clip 89. The mitt clip 89 acts as an adapter which has a passage 91 that extends vertically from the top portion through the bottom portion of the mitt clip 89. A user preferably places the mitt clip 89 at an upper end 93 of the extension member 83 and subsequently slides the mitt clip over the extension member 83. The mitt clip 89 may then be slid downwardly until abutting knob member 87.

Next, an aperture 95 that tunnels through each of the front and rear portions of the mitt clip 89 may receive and engage the knob member 87. Preferably, the knob member 87 has a circumference that is just smaller than the circumference of the aperture 95. As such, the aperture 95 is able to securely and tightly receive and engage the knob member 87 so that the mitt clip 89 is securely attached to the extension member 83. In a preferred embodiment, the knob member 87 includes some degree of elasticity such that it can be pushed inwardly when a user wants to release the mitt clip 89 from the extension member 83.

A mitt sew band 97 is preferably provided that is made of a washable material such as polyester. At its lower end 99, the mitt sew band 97 is preferably looped around the mitt clip 89. At its upper end 101, the mitt sew band is preferably sewn onto duster mitt 39. Thus, when the mitt sew band 97 is attached to both of the mitt clip 89 and the duster mitt 39, the duster mitt 39 is releaseably engageable with the extension member 83 via the mitt clip 89, as described above. Because the mitt dip 89 and the knob member 87 are selectively engageable with one another, the mitt 39 can be removed from the extension member 83. This may be useful if, for example, the duster mitt 39 is in need of cleaning or replacement. The duster mitt 39 is preferably made of a material that is recognized in the art for dusters, for example, a microfiber of polyester and nylon blend.

Figure 7:
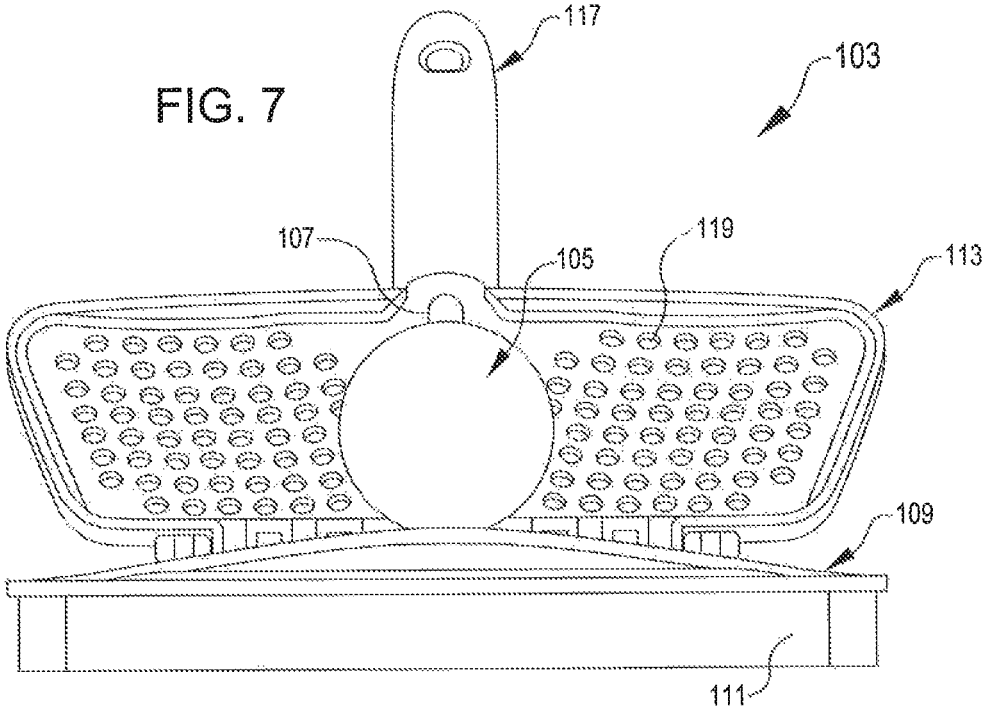
FIG. 7 is a front elevation view of a mop attachment member that is selectively engageable with the socket attachment device of FIGS. 2-4.
Figure 8:
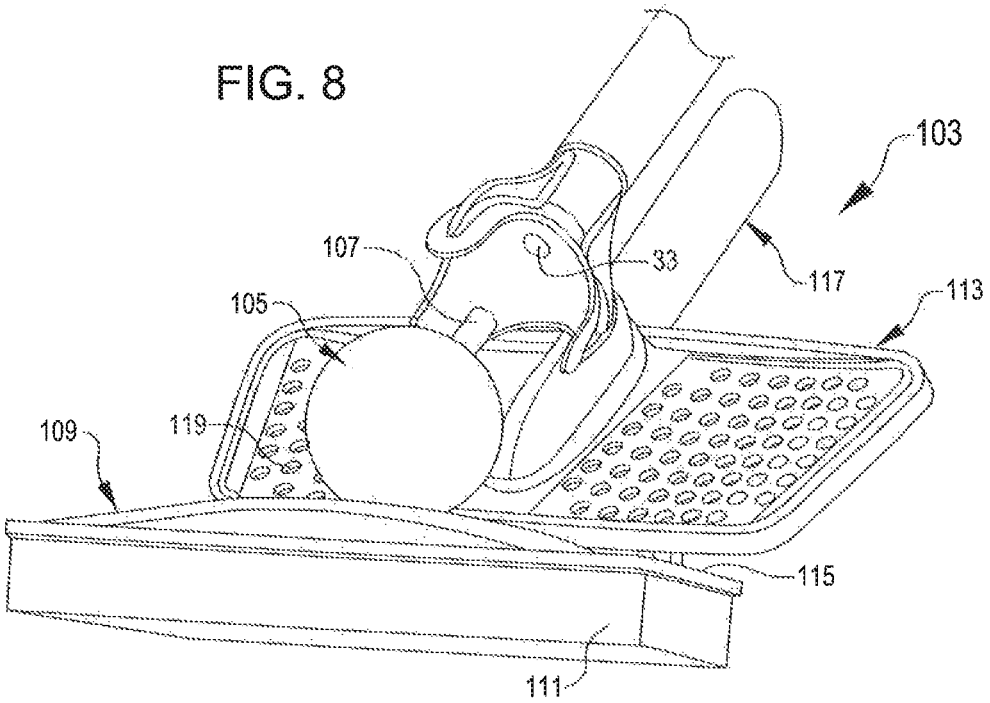
FIG. 8 is a perspective view of the mop attachment member of FIG. 7.
Figure 9:
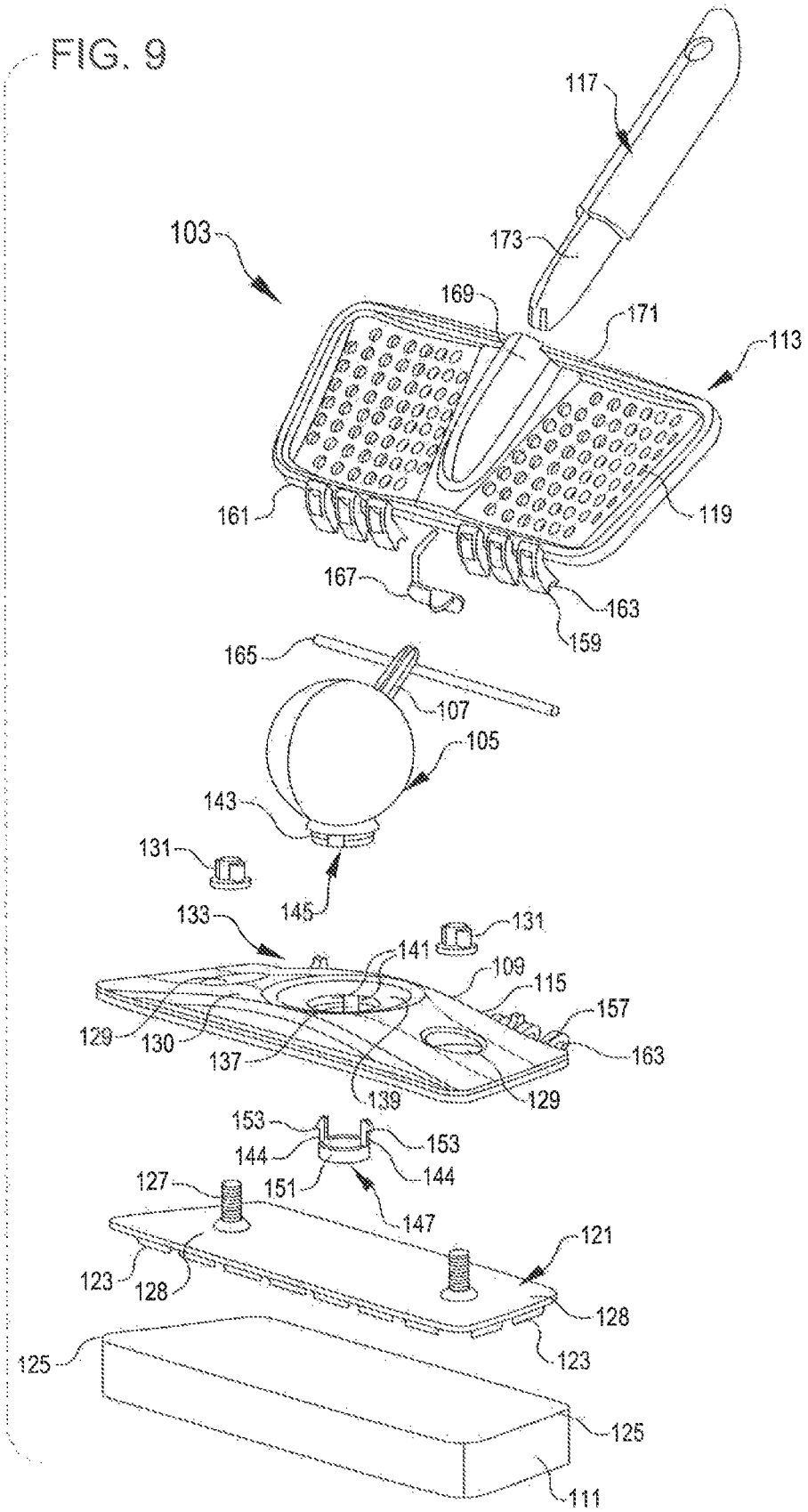
FIG. 9 is an exploded perspective view of the mop attachment member of FIGS. 6 and 7.

A second exemplar cleaning attachment member, mop attachment member 103, is provided in FIGS. 7-9. Like the duster attachment member 7, the mop member 103 includes a ball member 105. However, the ball member 105 associated with the mop member 103 further includes a cylinder-shaped rod or post 107 integrally formed with the ball member 105. The post 107 preferably extends upwardly away from the ball member 105. The post 107 is preferably of a size and shape that allows it to be received and secured within aperture 33 of throat 25 in the socket attachment device 5 (as shown in FIG. 8). When the rod 107 is received and secured within the aperture 33, the ball member 105 of mop member 103 is also secured within socket 25. Thus, the ball member 105 is unable to rotate within the socket 25. This allows the ball member 105 to remain securely in place and allows the mop member 103 to have one rotational degree of rotation roll. A user may prefer that the mop member 103 not otherwise move so that a mop remains rigid when used to vigorously scrub a floor or other principally flat surface.

In alternative embodiments, the post 107 and aperture 33 may take on different shapes. For example, they could be cross-shaped, or oval or otherwise non-uniformly shaped in cross-section. Such non-circular cross-sectional shapes generally prevent the attachment from having any rotational degrees of freedom, because the ability of the post to roll within the aperture about the longitudinal axis of the post 107 would be prevented.

Mop member 103 further includes a body member 109 that preferably includes a rectangular footprint having a surface area only slightly larger than the surface area of a sponge 111 attached thereto. The manner in which the sponge 111 is secured to the body member 109 is discussed in greater detail herein below. A wringer member 113 is preferably hingeably attached to the body member at a rear portion 115 of the mop member 103. The wringer member 113 preferably includes a handle 117 extending therefrom. The handle 117 allows a user to grasp the handle 117 and rotate the wringer member 113 rearwardly relative to the body member 109. As the wringer member 113 is rotated, it eventually abuts sponge 111. When the wringer member 113 abuts the sponge 111, the handle 117 may continue to be rotated toward the sponge 111 and body member 109. The wringer member 113 may then be squeezed and forced against the sponge 111, thus causing any liquid within the sponge 111 to be released. The wringer member 113 is provided with drain holes 119 through Which liquid from the wringer member 113 is dispensed. When a user is done wringing out the sponge 111, the wringer member 113 may be rotated back to its original position shown in FIGS. 6 and 7.

FIG. 9 illustrates an exploded view of the mop member 103. The sponge 111 is shown as substantially rectangular, though in alternative embodiments, the sponge 111 may take on other shapes, such as an oval shape or a circular shape. The sponge 111 is preferably fused to a backshell 121. The backshell 121 preferably includes raised retainer tabs 123 that are positioned and located substantially around the perimeter of the backshell 121. The tabs 123 are positioned and located such that they abut an outer perimeter surface 125 of the sponge 111 when the sponge 111 is fused to the backshell 121. The tabs 123 help to secure the sponge 111 in place when the mop member 103 is in use. The backshell 121 is shown as generally rectangular because the sponge 111 is also shown as generally rectangular. If the sponge 111 took on a different shape, the backshell 121 may also take on the shape of the sponge 111.

The backshell 121 is further provided with bolts 127 integrally formed therewith that extend upwardly from lateral side portions 128 of the backshell 121. The bolts 127 are positioned and located at the lateral side portions 128 of the backshell 121 because the body member 109 is also provided with apertures 129 that are located at its lateral side portions 130. The apertures 129 are positioned and located to receive the bolts 127 of the backshell 121 when the body member 109 and backshell 121 are placed in alignment with one another (as shown in FIG. 9). The apertures 129 are preferably recessed so that when the body member 109 abuts the backshell 125, lock nuts 131 may be screwed onto the bolts 127, but sunk into the recessed apertures 129.

A central portion 133 of the body member 109 also includes a central recessed aperture 137. The recessed aperture 137 is generally recessed in a concave shape, so that when the central recessed aperture 137 receives the ball member 105, the ball member 105 substantially abuts the bowl-shaped interior portion 139 substantially surrounding the central recessed aperture 137. An underside (not illustrated) of the body member 109 includes a plurality of interlocks 141 extending downwardly therefrom. The interlocks 141 are flange-like projections that are positioned and located around the circumference of the recessed aperture 137. The ball member 105 preferably includes locking projections 143 located on a base portion 145 of the ball member 105. The projections are preferably positioned and located around the circumference of the base portion 145 and may be substantially similar in size and shape to the interlocks 141.

When the ball member 105 is placed within the central recessed aperture 135, the projections 143 are preferably positioned and located below the interlocks 141. When the ball member 105 is rotated, the projections 143 are rotated below the interlocks 141 such that upper portions of the projections 143 abut lower portions of the interlocks 141. This arrangement prevents the ball member 105 from being pulled upwardly and away from the body member 109. The ball member 105 is further secured to the body member 109 by a ball lock nut 147. The ball lock nut 147 includes two upwardly extending flanges 149. The flanges 149 extend upwardly from a ring member 151 which is integrally formed with the flanges 149. The flanges 149 each also preferably include ledge members 153 at upper portions of the flanges 149. When the ball member 105 is secured within the central recessed aperture 137, the flanges 149 extend upwardly into an interior (not illustrated) of the ball member 105. The flanges 149 are able to inwardly flex when they enter the interior of the ball member 105. However, upon passing through an opening (not illustrated) of the ball member 105 that leads to its interior, the flanges 149 are able to return to their original substantially vertical position. The ledge members 153 of the flanges 149 preferably abut an interior locking member (not illustrated) of the interior of the ball member 105 in order to secure the ball member 105 in place. The ring member 151 preferably has a circumference just larger than the central recessed aperture 137 such that the ring member 151 is too large to fit upwardly through the central recessed aperture 137.

The body member 109 also preferably includes hook members 157 projecting from the rear portion 115 thereof. The hook members 157 are spaced at a distance from one another that is offset from receiver members 159 extending from a front portion 161 of the wringer member 113. When the front portion 161 of the wringer member 113 abuts the rear portion 115 of the body member 109, the receiver members 159 and hook members 157 are interlocked with one another in an alternating fashion. This arrangement allows for the front portion 161 of the wringer member 113 to abut the rear portion 115 of the body member 109. Each of the hook members 157 and the receiver members 159 also preferably include tunneled channels 163. The channels 163 are hollowed-out portions of the hook members 157 and receiver members 159 through which a pin member 165 may be inserted and secured. Pin 165 may releasably secure the hook members 157 to the receiver members 159 and thus the wringer member 113 to the body member 109. The pin 165 allows the wringer member 113 and the body member 109 to be hingedly attached. A spring 167 is further in contact with each of the front portion 161 of the wringer member 113 and the rear portion 115 of the body member 109 to bias the wringer member 113 at a particular angle relative to the body member 109. In the example embodiment shown, the wringer member 113 is biased at approximately 45° relative to the body member 109.

The wringer member 113 further includes a sleeve member 169 located at a rear portion 171 of the wringer member 113. The handle 117 includes an extension member 173 having a size, shape and configuration just smaller than the sleeve member 169. When the extension member 173 is inserted into the sleeve member 169, the extension member 173 is snuggly secured within the sleeve member 169. A ledge 175 that is formed where the extension member 173 ends abuts a rim of the sleeve member 169 (not illustrated) so that the handle 117 is releasably but firmly secured within sleeve member 169. As described above, the handle 117 may be used to rotate the wringer member 113 rearwardly so that it can wring out the sponge 111. After wringing out the sponge 111, the spring 167 preferably biases the wringer member 113 so that it and the handle return to its original biased position.

Another exemplar cleaning attachment member, mop attachment member 180, is provided in FIGS. 10-13. Like the mop member 103 of FIGS. 7-9, mop member 180 includes a ball member 182. However, the ball member 182 associated with the mop member 180 further includes a rod or post 184 integrally formed with the ball member 180. The post 184 preferably extends upwardly away from the ball member 182, and includes an undercut (notched) portion 186. The undercut portion 186 can be positioned on a backside 188 of the post 184, or in the alternative, the undercut portion 186 can extend about the circumference of the post 184.

Figure 12:
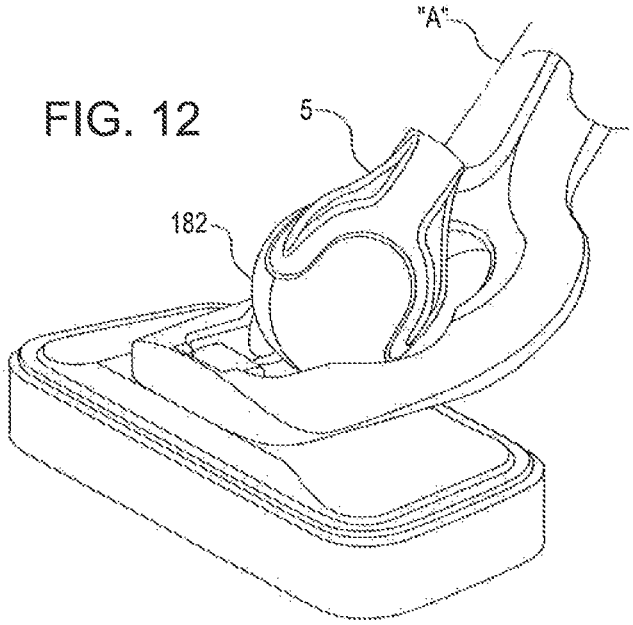
FIG. 12 is a perspective view of alternative mop attachment member of FIG. 10 that is selectively engageable with the socket attachment device of FIGS. 2-4.
Figure 13:
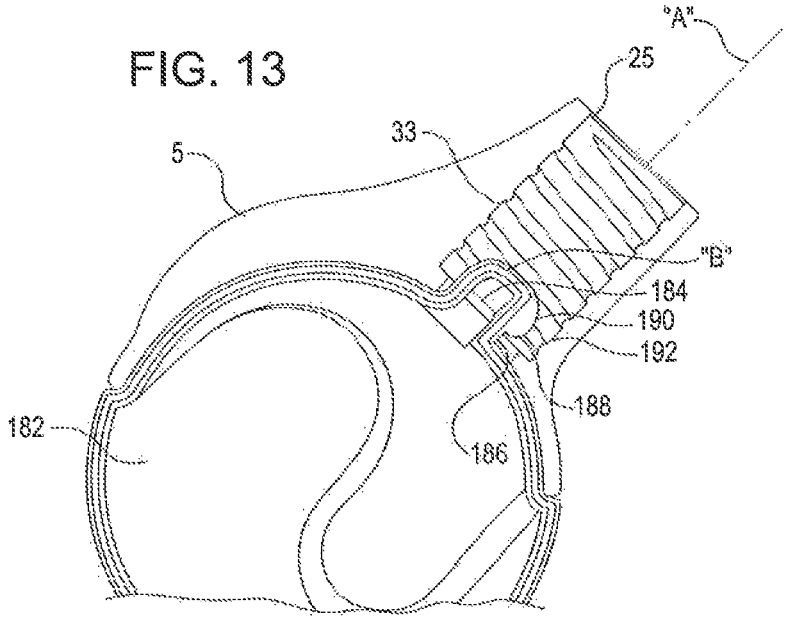
FIG. 13 is a side sectional view of the alternative mop attachment member of FIG. 10 engaging with the socket attachment device of FIGS. 2-4.

The post 184 is preferably of a size and shape that allows it to be received and secured within aperture 33 of throat 25 in the socket attachment device 5 (as shown in FIG. 12). When the post 184 is received and secured within the aperture 33, the ball member 182 of mop member 180 is also secured within socket 5. Thus, the ball member 180 is unable to rotate within the socket 5. This allows the ball member 182 to remain securely in place and allows the mop member 180 to have one rotational degree of rotation roll.

A radius 188 of the undercut portion 186 is size such that when a longitudinal axis A of the aperture 33 is not aligned with the longitudinal axis B of the post 184, a portion of the outside surface 190 of the post 184 engaging an inner surface 192 of the aperture 33, making it difficult to separate the ball 180 from the socket attachment member 5. To separate the ball 180 from the socket attachment device 5, the longitudinal axis A of the aperture 33 is aligned with the longitudinal axis B of the post 184, allowing the post 184 to be removed from the aperture 33 of the throat 25.

The cleaning device 1 may be used with a variety of cleaning attachments other than duster attachment member 7 and mop attachment member 103, or other duster and mop attachments having different constructions from the examples discussed herein. The other foreseeable cleaning attachments all preferably include a ball member that is selectively engageable with the socket 25. Depending on the intended use for the attachment, the ball member may or may not include a rod or post such as post 107 to limit the attachment's degrees of freedom.

From the foregoing, it will be seen that the various embodiments of the present invention are well adapted to attain all the objectives and advantages hereinabove set forth together with still other advantages which are obvious and which are inherent to the present structures. Since many possible embodiments of the present invention may be made without departing from the spirit and scope of the present invention, it is to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Thus, there has been shown and described several embodiments of a novel selectively adjustable cleaning device. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required."

Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A selectively adjustable cleaning device, the cleaning device comprising:

a handle member including a socket member, the socket member including:

a plurality of downwardly extending resilient flexible claw members, the claw members including inwardly contoured interior portions; and a substantially sphere-shaped socket formed between the flexible claw members; and an attachment member including a ball member, wherein the ball member is removeably engageable with the socket member to form a pivot joint with three-degrees of rotational freedom, and wherein the ball member is oversized for the socket member so that the socket member allows impeded rotation of the ball member within the socket member.

2. The selectively adjustable cleaning device as set forth in claim 1 wherein the attachment member includes a cleaning implement.

* * * * *